US010700404B2

(12) United States Patent
Han

(10) Patent No.: US 10,700,404 B2
(45) Date of Patent: Jun. 30, 2020

(54) MULTILAYER DIRECTIONAL COUPLER

(71) Applicant: Samsung Electro-Mechanics Co., Ltd., Suwon-si (KR)

(72) Inventor: Myeong Woo Han, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 30 days.

(21) Appl. No.: 15/997,972

(22) Filed: Jun. 5, 2018

(65) Prior Publication Data

US 2019/0165444 A1 May 30, 2019

(30) Foreign Application Priority Data

Nov. 29, 2017 (KR) ..... 10-2017-0161927

(51) Int. Cl.
*H01P 5/18* (2006.01)
*H01P 5/08* (2006.01)
*H01P 3/08* (2006.01)

(52) U.S. Cl.
CPC ..... *H01P 5/183* (2013.01); *H01P 5/085* (2013.01); *H01P 5/187* (2013.01)

(58) Field of Classification Search
CPC .. H01P 5/18; H01P 5/184; H01P 5/187; H01P 3/08
USPC ..... 333/109, 116
See application file for complete search history.

(56) References Cited

U.S. PATENT DOCUMENTS 3,513,414 A * 5/1970 Howe, Jr. ..... H01P 5/187 333/116
5,424,694 A * 6/1995 Maloratsky ..... H01P 5/185 333/112
6,765,455 B1 * 7/2004 De Lillo ..... H01P 5/185 333/116
6,972,640 B2 * 12/2005 Nagamori ..... H01P 5/185 333/116
8,289,102 B2 * 10/2012 Yamamoto ..... H01P 5/184 333/116
8,643,447 B2 * 2/2014 Chen ..... H01P 5/187 333/109
9,184,483 B2 * 11/2015 Zeller ..... H01P 5/185
9,214,715 B2 * 12/2015 Mei ..... H01P 5/184
2014/0292440 A1 * 10/2014 Hirota ..... H01P 5/187 333/116
2015/0207199 A1 * 7/2015 Otsuki ..... H01P 5/187 333/24 R
2016/0359216 A1 * 12/2016 Kase ..... H03F 3/195
2017/0141451 A1 5/2017 Weiss
(Continued)

FOREIGN PATENT DOCUMENTS

JP 2000-165117 A 6/2000
KR 10-1665589 B1 10/2016
KR 10-2016-0133557 A 11/2016

*Primary Examiner* — Dean O Takaoka
(74) *Attorney, Agent, or Firm* — NSIP Law

(57) ABSTRACT

There is provided a multilayer directional coupler formed in a wireless communications device formed by stacking a plurality of substrates, comprising a first conductive pattern formed on a first substrate among the plurality of substrates; and a second conductive pattern formed on a second substrate stacked on one surface of the first substrate and having one or more conductive lines overlapping the first conductive pattern when viewed in a plane direction.

20 Claims, 9 Drawing Sheets

(56) References Cited

U.S. PATENT DOCUMENTS

2017/0237140 A1* 8/2017 Dakhiya ..... H01P 5/187
333/116
2018/0013407 A1* 1/2018 Na ..... H01L 23/66

* cited by examiner

MULTILAYER DIRECTIONAL COUPLER

CROSS-REFERENCE TO RELATED APPLICATION

This application claims the benefit under 35 USC 119(a) to Korean Patent Application No. 10-2017-0161927 filed on Nov. 29, 2017 in the Korean Intellectual Property Office, the disclosure of which is incorporated herein by reference for all purposes.

BACKGROUND

1. Field

This application relates to a multilayer directional coupler.

2. Description of Related Art

In the wireless system environment, and in particular, in the high frequency environment, a directional coupler is an important element used for power extraction and power distribution.

As existing directional couplers, horizontal coupling couplers having a structure in which different conductive lines are arranged on the same plane, while being coupled to each other in a horizontal direction, are used.

However, in the case of the existing horizontal coupling coupler, since the conductive lines should be separated from each other by a certain distance or more due to limitations in a manufacturing process of the conductive lines, there are limiting, in that mutual capacitance or coupling power may be manufactured only to a certain extent or less.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a multilayer directional coupler formed in a wireless communications device formed by stacking a plurality of substrates, the multilayer directional coupler includes a first conductive pattern formed on a first substrate among the plurality of substrates; and a second conductive pattern formed on a second substrate stacked on a surface of the first substrate and formed to have one or more conductive lines overlapping the first conductive pattern when viewed in a plane direction.

The first conductive pattern may have a first end connected to an input port and a second end connected to a through port, and the second conductive pattern has a first end connected to an isolation port and a second end connected to a coupling port.

The first conductive pattern may include a first partial pattern extending in a first direction; a first terminal pattern having a first end connected to a first via electrode; and a second terminal pattern having a first end connected to a second via electrode.

A first end of the first partial pattern may be connected to the second end of the first terminal pattern, and the second end of the first partial pattern is connected to the second end of the second terminal pattern.

The first conductive pattern may include a first connection pattern connected to a first end of the first partial pattern and the second end of the first terminal pattern; and a second connection pattern connected to the second end of the first partial pattern and the second end of the second terminal pattern.

The second conductive pattern may include a second partial pattern at least partially overlapping the first partial pattern when viewed in the plane direction.

The multilayer directional coupler may further include a capacitor formed to have a first end connected to the first conductive pattern and a second end connected to the second conductive pattern.

The capacitor may be formed on an uppermost layer among the plurality of substrates and has the first end connected to the first conductive pattern through a first via electrode and the second end connected to the second conductive pattern through a second via electrode.

The multilayer directional coupler may further include a third conductive pattern formed on a third substrate stacked on a surface of the second substrate and may be formed to have one or more conductive lines overlapping with at least one of the first conductive pattern and the second conductive pattern when viewed in the plane direction.

A number of ports of the directional coupler may be greater than four.

According to another general aspect, a multilayer directional coupler formed in a wireless communications device formed by stacking a plurality of substrates, the multilayer directional coupler includes a first conductive pattern formed on a first substrate among the plurality of substrates; a second conductive pattern formed on a second substrate stacked on a surface of the first substrate and formed to have one or more conductive lines overlapping the first conductive pattern when viewed in a plane direction; and a third conductive pattern formed on a third substrate stacked on a surface of the second substrate and formed to have one or more conductive lines overlapping with at least one of the first conductive pattern and the second conductive pattern when viewed in the plane direction.

The first conductive pattern may have a first end connected to a first input port and a second end connected to a first through port, the second conductive pattern has a first end connected to an isolation port and a second end connected to a coupling port, and the third conductive pattern has a first end connected to a second input port and a second end connected to a second through port.

The first conductive pattern may include a first partial pattern extending in a first direction; a first terminal pattern having a first end connected to a first via electrode; and a second terminal pattern having a first end connected to a second via electrode.

The second conductive pattern may include a second partial pattern at least partially overlapping the first partial pattern when viewed in the plane direction.

The third conductive pattern may include a third partial pattern at least partially overlapping the first partial pattern and the second partial pattern when viewed in the plane direction.

The multilayer directional coupler may further include a capacitor formed to have a first end connected to the first conductive pattern and a second end connected to the second conductive pattern.

The multilayer coupler further may include a capacitor formed to have a first end connected to the third conductive pattern and a second end connected to the second conductive pattern.

The capacitor may be formed on an uppermost layer among the plurality of substrates and has the first end connected to the first conductive pattern through a first via electrode and the second end connected to the second conductive pattern through a second via electrode.

According to another aspect, a multilayer directional coupler formed in a wireless communications device formed by stacking a plurality of substrates, the multilayer directional coupler includes a first conductive pattern formed on a first substrate among the plurality of substrates; a second conductive pattern formed below a second substrate stacked on a surface of the first substrate and formed to have one or more conductive lines overlapping the first conductive pattern when viewed in a plane direction; and a capacitor formed to have a first end connected to the first conductive pattern and a second end connected to the second conductive pattern.

Capacitance between the first conductive pattern and the second conductive pattern may be adjusted by controlling capacitance values of the capacitor.

The capacitor may be formed on an uppermost layer among the plurality of substrates and has the first end connected to the first conductive pattern through a first via electrode and the second end connected to the second conductive pattern through a second via electrode.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
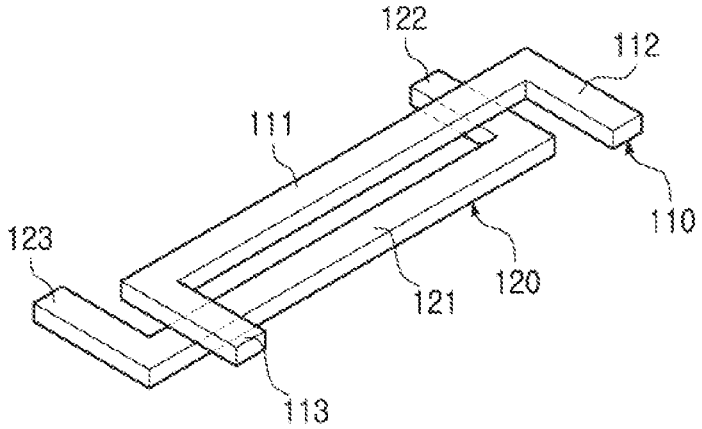
FIG. 1 is a perspective view schematically showing an example of a multilayer directional coupler.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

FIG. 1 is a perspective view schematically illustrating an example of a multilayer directional coupler.

Referring to FIG. 1, the multilayer directional coupler may be a four-port type directional coupler, and includes a first conductive line 110 and a second conductive line 120 disposed in a direction perpendicular to the first conductive line 110. However, the four-port type directional coupler is only an example, and a directional coupler according to an example may include a number of ports greater than four, for example, six-ports, eight-ports, ten-ports, etc.

That is, the first conductive line 110 may be formed on a first substrate of a multilayer substrate, and the second conductive line 120 is formed on a second substrate of the multilayer surface. The second substrate may be stacked on or above a surface of the first substrate.

The first conductive line 110 and the second conductive line 120 may be conductive lines that are formed on a specific substrate in an area of the multilayer substrate.

The first conductive line 110 may be a main conductive line that has one end connected to an input port and the other end connected to a through port. The second conductive line 120 may be an auxiliary conductive line having one end connected to an isolation port and the other end connected to a coupling port.

At least a part of the first conductive line 110 may be disposed perpendicular to at least a part of the second conductive line 120. That is, when viewed in a plane direction, at least a part of the first conductive line 110 may overlap at least a part of the second conductive line 120.

As illustrated in FIG. 1, the first conductive line 110 may include a first partial pattern 111 extending in a first direction, and first and second terminal patterns 112 and 113 connected to the first partial pattern 111. The first partial pattern 111 is formed to connect the first terminal pattern 112 to the second terminal pattern 113. The first terminal pattern 112 and the second terminal pattern 113 may be connected in a perpendicular direction to the first partial pattern 111, but is not limited thereto. Similarly, the second conductive line 120 may also include a second partial pattern 121 extending in the first direction, and third and fourth terminal patterns 122 and 123 connected to the second partial pattern 121. The second partial pattern 121 is formed to connect third terminal pattern 122 to the fourth terminal pattern 123.

As illustrated in FIG. 1, the first partial pattern 111 and the second partial pattern 121 may be positioned to overlap each other in a vertical direction, that is, when viewed in a plane direction.

Accordingly, example exist where an interval between the first partial pattern 111 and the second partial pattern 121 is formed to be only several tens of μm. This is because the required space for a distance between conductors in a horizontal direction on the same plane is usually larger than the required space between vertical planes in a stacked type. As a result, the multilayer directional coupler may form the interval between the two conductive lines to be narrower when the first conductive line and the second conductive line are arranged in the vertical direction than when the first conductive line and the second conductive line are arranged in the horizontal direction.

On the other hand, the multilayer directional coupler may be internally formed in various wireless communications devices formed of the multilayer substrate.

Hereinafter, a multilayer directional coupler formed in the multilayer wireless communications device will be described with reference to FIGS. 2 and 3A through 3F.

Figure 2:
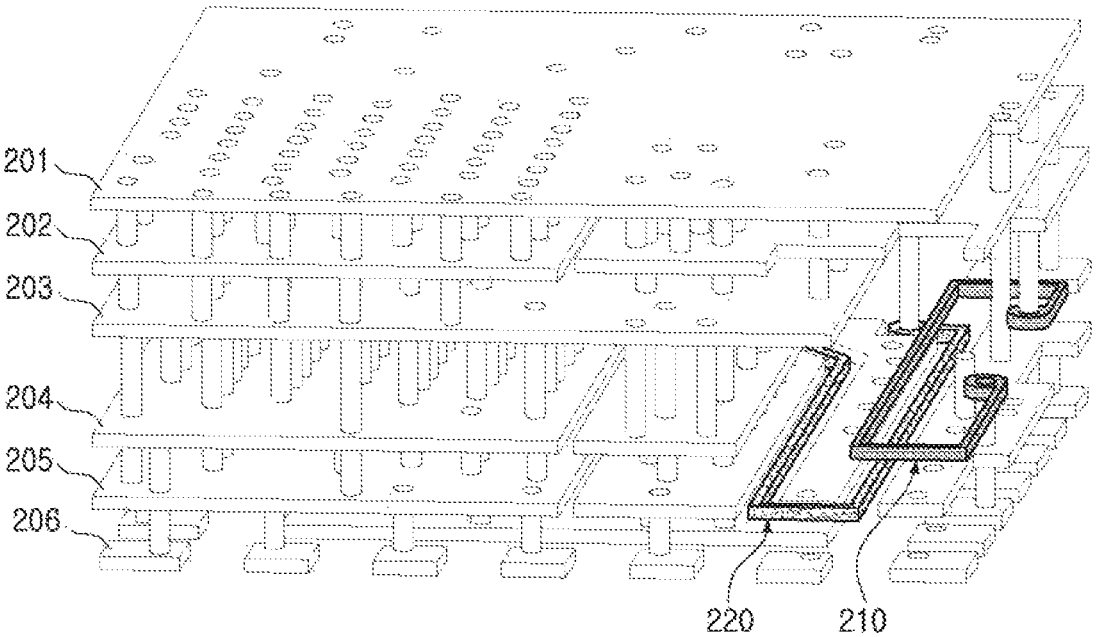
FIG. 2 is a perspective view schematically showing an example of a multilayer directional coupler formed in a multilayer wireless communications device.

FIG. 2 is a perspective view schematically illustrating an example of a multilayer directional coupler formed in a multilayer wireless communications device according to the present disclosure, and FIGS. 3A through 3F are plan views illustrating examples of each layer of the multilayer wireless communications device illustrated in FIG. 2.

Figure 3A:
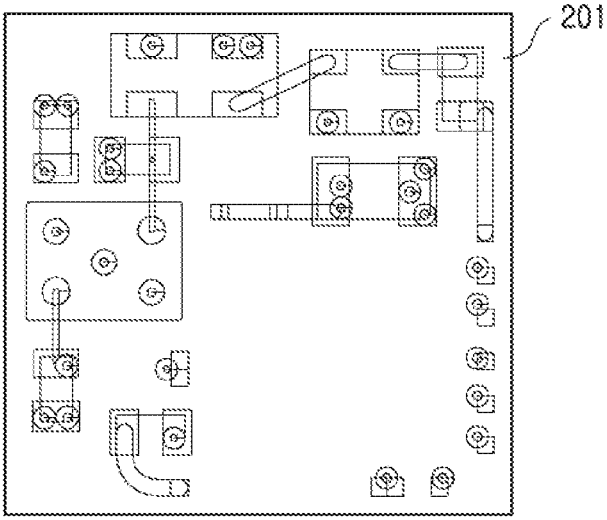
FIGS. 3A through 3F are plan views of an example of each layer of a multilayer wireless communications device illustrated in FIG. 2.
Figure 3B:
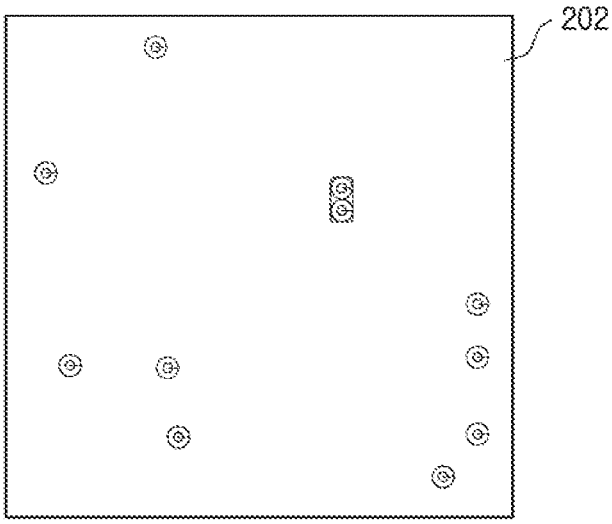
Figure 3C:
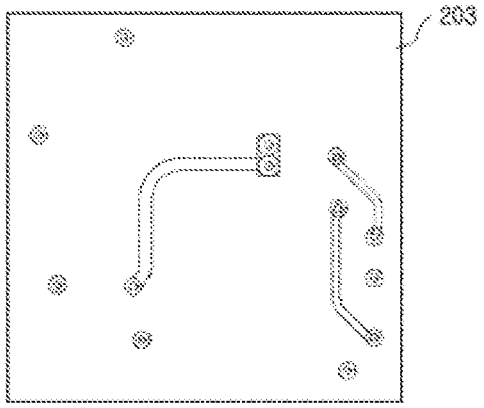
Figure 3D:
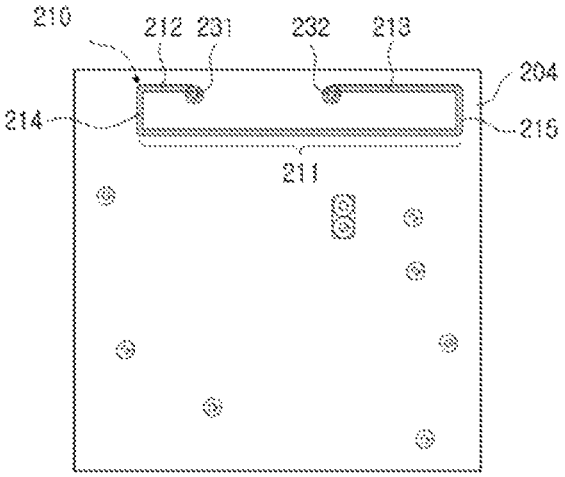
Figure 3E:
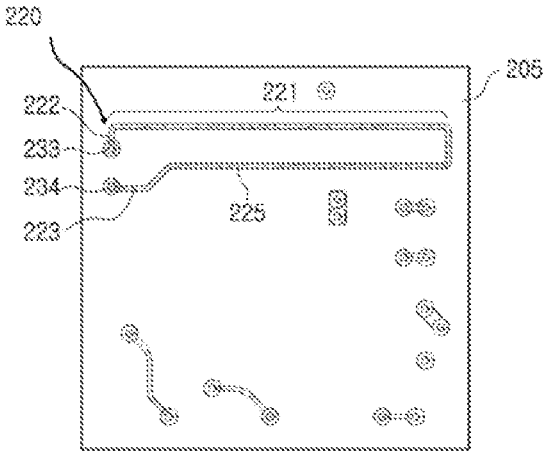
Figure 3F:
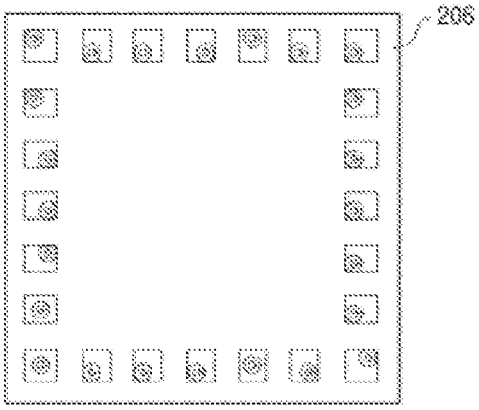

Referring to FIGS. 2 and 3F, the multilayer wireless communications device is formed by stacking a plurality of substrates 201 to 206.

Further, the multilayer directional coupler may be formed in the multilayer wireless communications device.

The multilayer directional coupler may include a first conductive pattern 210 which is formed on a first substrate 204 among the plurality of substrates 201-206, and a second conductive pattern 220 which is formed on a second substrate 205 that is stacked on or below a surface of the first substrate 204 and has at least some conductive lines overlapping the first conductive pattern 210 when viewed in the plane direction.

As shown in the illustrated example of FIG. 2, there may be a space between the first substrate 204 and the second substrate 205. Mutual capacitance may be determined on the basis of the space between the first substrate 204 and the second substrate 205. Alternatively, even if there is no space between the two substrates, materials, other than a predetermined insulation material, that are located between the first substrate 204 and the second substrate 205 may allow a capacitance to be formed between the first conductive pattern 210 and the second conductive pattern 220.

Various electronic components such as capacitors and inductors may be provided on an uppermost substrate of the multilayer wireless communications device, and a via electrode, which may be formed by being filled in the conductive line or a via hole, may be formed on an internal substrate of the multilayer wireless communications device.

In the illustrated example of FIG. 3D, the first conductive pattern 210 may include a first partial pattern 211 extending in a first direction. The first partial pattern 211 is disposed in a direction perpendicular to the second partial pattern 221 of the second conductive pattern 220 (FIG. 3E).

The first conductive pattern 210 (FIG. 3D) includes a first terminal pattern 212 having a first end thereof connected to a first via electrode 231 and a second terminal pattern 213 having a first end thereof connected to a second via electrode 232.

In addition, the first conductive pattern 210 may further include a first connection pattern 214 connected to a first end of the first partial pattern 211 and a second end of the first terminal pattern 212, and a second connection pattern 215 connected to a second end of the first partial pattern 211 and a second end of the second terminal pattern 213.

Accordingly, in the illustrated example, the first conductive pattern 210 has a rectangular shape in which a part of one surface of the first conductive pattern 210 is open. However, the shape of the first conductive pattern 210 is not limited thereto.

For example, as illustrated in FIG. 2, the first conductive pattern 210 may have a rectangular shape in which one surface is omitted. In this case, a first end of the first partial pattern may be connected to second end of the first terminal pattern and the second end of the first partial pattern may be connected to the second end of the second terminal pattern.

Alternatively, in addition to this, in other examples, the first conductive pattern 210 has various forms including the first partial pattern.

Similarly, the second conductive pattern 220 may include a second partial pattern 221 which at least partially overlaps with the first partial pattern 211 when viewed in the plane direction.

In addition, as shown in FIG. 3E, the second conductive pattern 220 may include a first terminal pattern 222 connected to a first via electrode 233, a second terminal pattern 223 connected to a second via electrode 234, and a connection pattern 225 connecting the second terminal pattern 223 to the second partial pattern 221, but is not limited thereto.

On the other hand, in the above description, the conductive pattern is divided into the partial pattern, the terminal pattern, the connection pattern, and the like. However, the partial pattern, the terminal pattern, the connection pattern, and the like are only for describing the structure of the conductive pattern, and may not be formed separately from each other. Therefore, one conductive pattern may be formed through one process.

Figure 4:
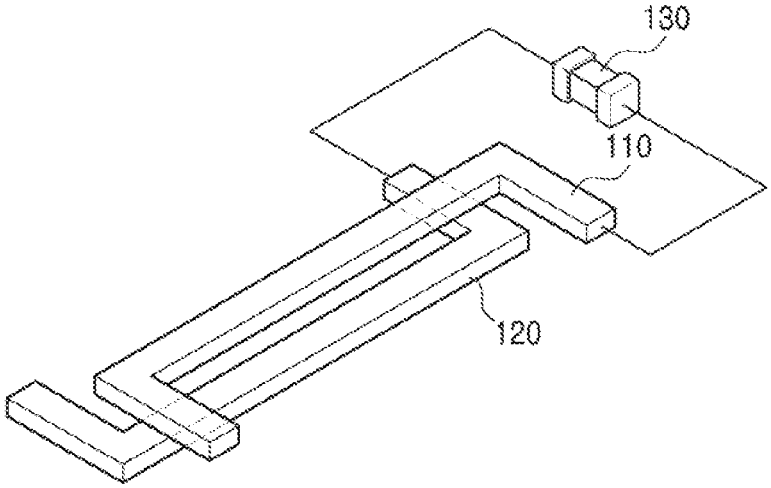
FIG. 4 is a perspective view schematically showing an example of a multilayer directional coupler.

FIG. 4 is a perspective view schematically illustrating a multilayer directional coupler according to another example of the present disclosure. According to the example illustrated in FIG. 4, the multilayer directional coupler may further include a capacitor 130.

Referring to FIG. 4, the multilayer directional coupler may include the first conductive pattern 110, the second conductive pattern 120, and the capacitor 130.

The first conductive pattern 110 and the second conductive pattern 120 may be understood from the above description with reference to FIGS. 1 through 3.

A first end of the capacitor 130 may be connected to the first conductive pattern 110 and the second end thereof may be connected to the second conductive pattern 120. FIG. 4 illustrates that the capacitor 130 is connected to one end of the first conductive pattern 110 and one end of the second conductive pattern 120, but the configuration of the capacitor 130 is not limited thereto.

In the example, the capacitor 130 may be formed on the uppermost layer substrate of the multilayer wireless communications device. That is, one end of the capacitor 130 may be connected to the first conductive pattern formed on the first substrate through the first via electrode, and the other end of the capacitor 130 may be connected to the second conductive pattern formed on the second substrate through the second via electrode.

The capacitor may be used to adjust settings of the multilayer directional coupler. That is, since the multilayer directional coupler is formed inside the multilayer substrate, it is difficult to adjust the various values of the coupler.

On the other hand, in the example, the capacitance between the two transmission lines of the multilayer directional coupler may be adjusted by adjusting the capacitance of the capacitor 130, that is, by facilitating the setting of the capacitor 130 positioned on the uppermost layer to various values. Accordingly, the detailed setting of the multilayer directional coupler may be performed more smoothly by adjusting the capacitor.

The four-port directional coupler has been described above with reference to FIGS. 1 through 4. The four-port directional coupler is only an example, and couplers with varying amounts of ports may be used. Hereinafter, a six-port directional coupler will be described with reference to FIGS. 5 through 8.

The same features as those described above with reference to FIGS. 1 through 4 or the features that may be easily understood therefrom will be omitted.

Figure 5:
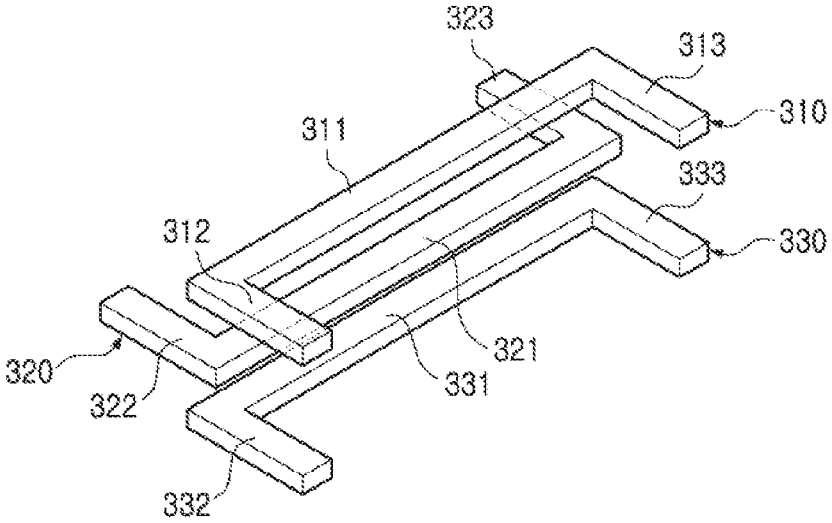
FIG. 5 is a perspective view schematically showing an example of a multilayer directional coupler.

FIG. 5 is a perspective view schematically illustrating a multilayer directional coupler according to another example of the present disclosure.

Referring to FIG. 5, the multilayer directional coupler is a six-port type coupler, and may include a first conductive line 310, a second conductive line 320 disposed in a direction perpendicular to the first conductive line 310, and a third conductive line 330 disposed in a direction perpendicular to the first conductive line 310 and the second conductive line 320.

That is, the first conductive line 310 may be formed on a first substrate of the multilayer substrate, and the second conductive line 320 may be formed on a second substrate formed on one surface of the first substrate, and the third conductive line 330 may be formed on a third substrate of the multilayer substrate. The third substrate may be formed on or above a surface of the second substrate.

The first conductive line 310 and the second conductive line 320 may be conductive lines formed on a specific substrate in the environment of the multilayer substrate.

The first conductive line 310 may be a main conductive line having a first end connected to a first input port and a second end connected to a first through port. The second conductive line 320 may be an auxiliary conductive line having a first end connected to an isolation port and a second end connected to a coupling port. The third conductive line 330 may be another main conductive line having a first end connected to a second input port and a second end connected to a second through port.

As illustrated in FIG. 5, the first conductive line 310 may include a first partial pattern 311 extending in a first direction, and first and second terminal patterns 312 and 313 connected to the first partial pattern 111. The first partial pattern 311 also connects both terminal pattern 312 and terminal pattern 313 to each other.

Similarly, the second conductive line 320 may also include a second partial pattern 321 extending in the first direction, and first and second terminal patterns 322 and 323 connected to the second partial pattern 321. The second partial pattern 321 also connects both terminal pattern 322 and terminal pattern 323 to each other.

The third conductive line 330 may also include a third partial pattern 331 extending in the first direction, and first and second terminal patterns 332 and 333 connected to the third partial pattern 331. The third partial pattern 331 also connects both terminal pattern 332 and terminal pattern 333 to each other.

As illustrated in FIG. 5, the first partial pattern 311, the second partial pattern 321, and the third partial pattern 331 may be positioned to overlap each other in a vertical direction, that is, when viewed in a plane direction.

Figure 6:
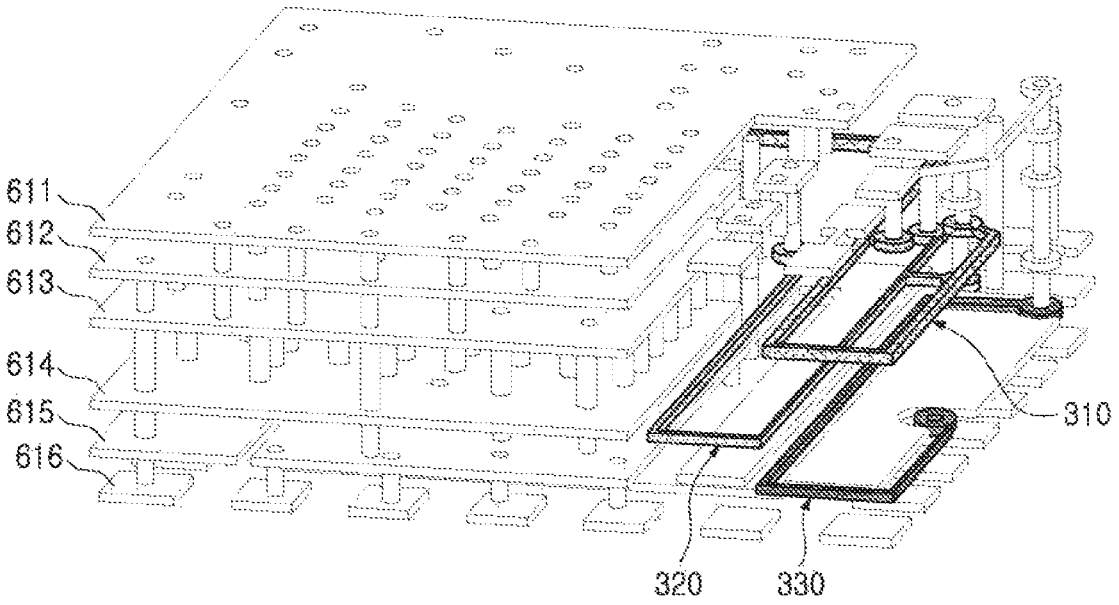
FIG. 6 is a perspective view schematically showing an example of a multilayer directional coupler formed in a multilayer wireless communications device.

FIG. 6 is a perspective view schematically illustrating an example of a multilayer directional coupler formed in a multilayer wireless communications device according to the present disclosure, and FIGS. 7A through 7F are plan views illustrating examples of each layer of the multilayer wireless communications device illustrated in FIG. 3.

Figure 7A:
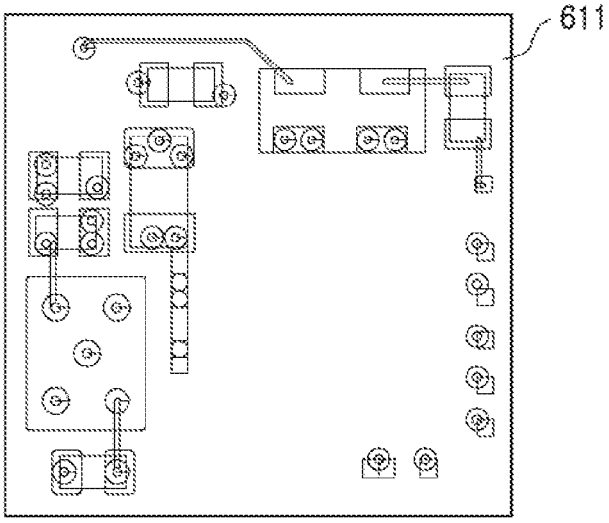
FIGS. 7A through 7F are plan views of an example of each layer of a multilayer wireless communications device.
Figure 7B:
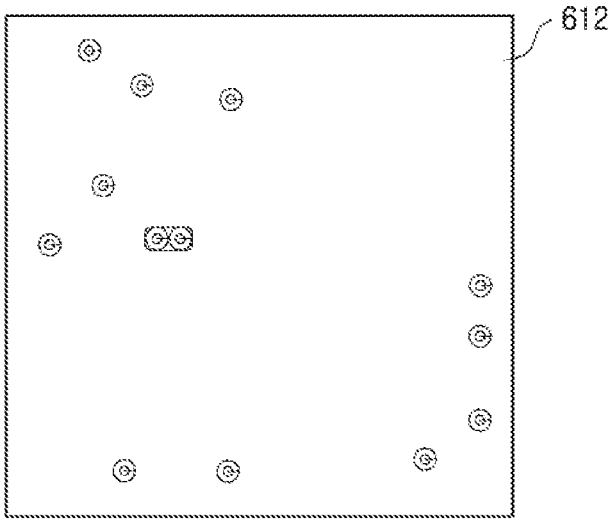
Figure 7C:
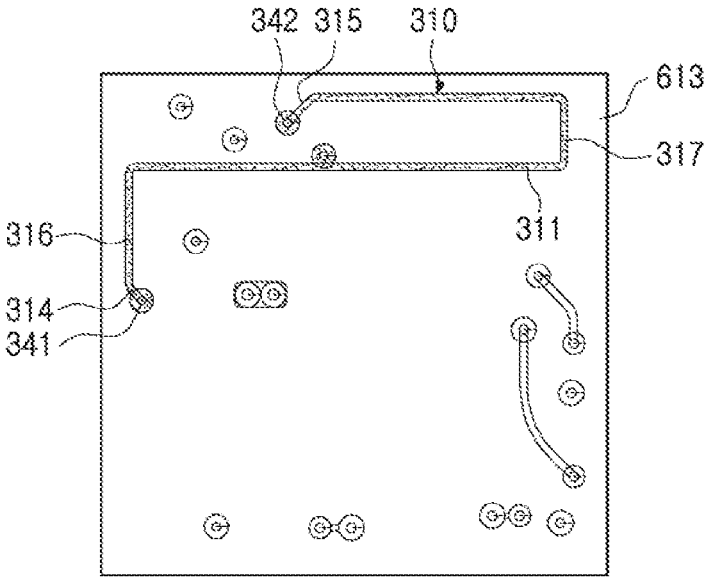
Figure 7D:
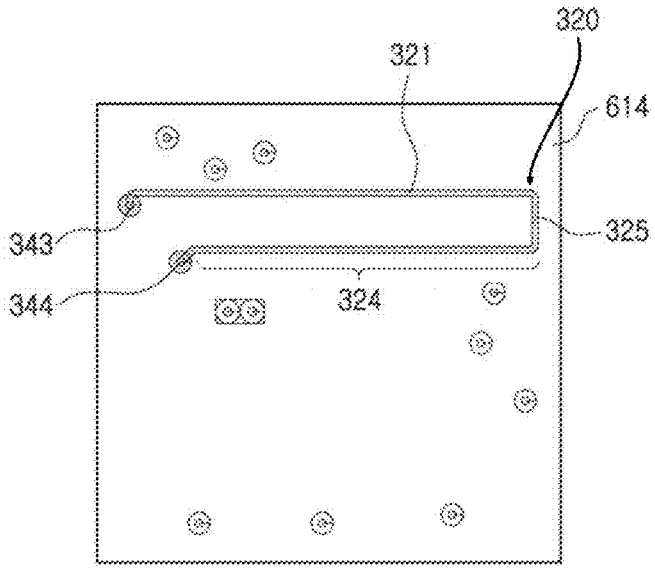
Figure 7E:
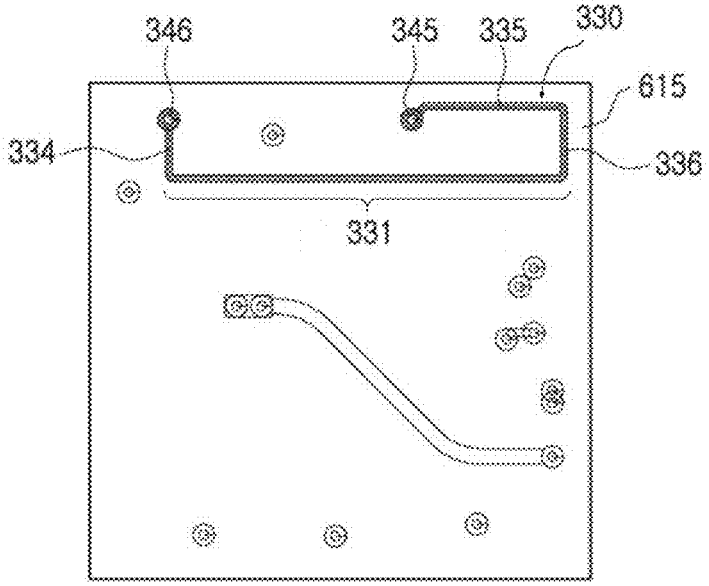
Figure 7F:
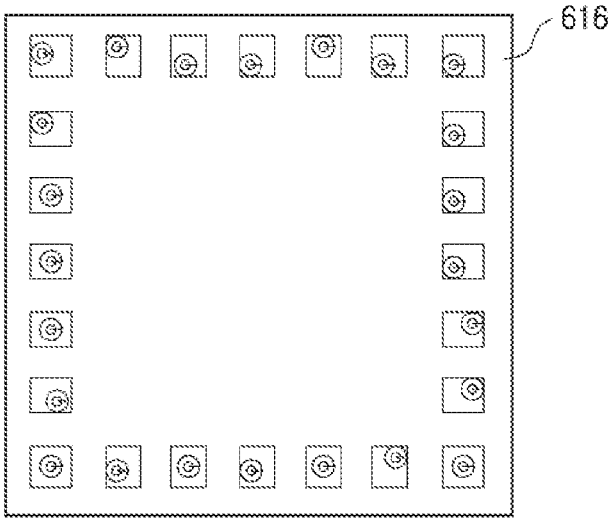

Referring to FIGS. 6 through 7F, the multilayer wireless communications device is formed by stacking a plurality of substrates 611 to 616. Further, the multilayer directional coupler is formed in the multilayer wireless communications device.

The multilayer directional coupler may include a first conductive pattern 310 formed on a first substrate 613 among a plurality of substrates 611-616, a second conductive pattern 320 formed on a second substrate 614 stacked on or below a surface of the first substrate 613 and having at least some conductive lines overlapping the first conductive pattern 310 when viewed in a plane direction, and a third conductive pattern 330 formed on a third substrate 615 stacked on or below a surface of the second substrate 614 and having at least some conductive lines overlapping with at least one of the first conductive pattern 310 and the second conductive pattern 320 when viewed in the plane direction. The formation of the multilayer directional coupler on the first substrate 613, the second substrate 614, and the third substrate 615 is only an example. The multilayer directional coupler may be formed on any of the substrates.

As shown in the illustrated example in FIG. 6, there may be a an air-gap between the first substrate 613 and the second substrate 614. Mutual capacitance may be determined on the basis of the air-gap between the first substrate 613 and the second substrate 614. Alternatively, even if there is no air-gap between the two substrates, materials, other than a predetermined insulation material, that are located between the first substrate 613 and the second substrate 614 may allow a capacitance to be formed between the first conductive pattern 310 and the second conductive pattern 320.

Various electronic components such as capacitors and inductors may be provided on an uppermost substrate of the multilayer wireless communications device, and a via electrode, which may be formed by being filled in the conductive line or a via hole, may be formed on an internal substrate of the multilayer wireless communications device.

In the illustrated example shown in FIG. 5, the first conductive pattern 310 may include a first partial pattern 311 extending in a first direction. The first partial pattern 311 is disposed in a direction perpendicular to the second partial pattern 321 of the second conductive pattern 320.

Turning now to FIG. 7C, the first conductive pattern 310 may include a first terminal pattern 314 having a first end connected to a first via electrode 341 and a second terminal pattern 315 having a first end connected to a second via electrode 342. In addition, the first conductive pattern 310 may further include a first connection pattern 316 connected to a first end of the first partial pattern 311 and the second end of the first terminal pattern 314, and a second connection pattern 317 connected to the second end of the first partial pattern 311 and the second end of the second terminal pattern 315.

However, the shape of the first conductive pattern 310 is not limited to the shape.

Similarly, with regard to FIG. 7D, the second conductive pattern 320 may include a second partial pattern 321 which at least partially overlaps with the first partial pattern 311 when viewed in the plane direction.

Further, a first end of the second partial pattern 321 may be connected to the first via electrode 343. The second conductive pattern 320 may include a first terminal pattern 324 connected to the second via electrode 344, and a connection pattern 325 connecting the first terminal pattern 324 and the second partial pattern 321, but is not limited thereto.

Similarly, referring to FIG. 7E, the third conductive pattern 330 may include a third partial pattern 331 which at least partially overlaps with the first partial pattern 311 or the second partial pattern 321 when viewed in the plane direction. In addition to the third partial pattern 331, the third conductive pattern 330 may include various terminal patterns 334 and 335 or connection patterns 336.

Figure 8:
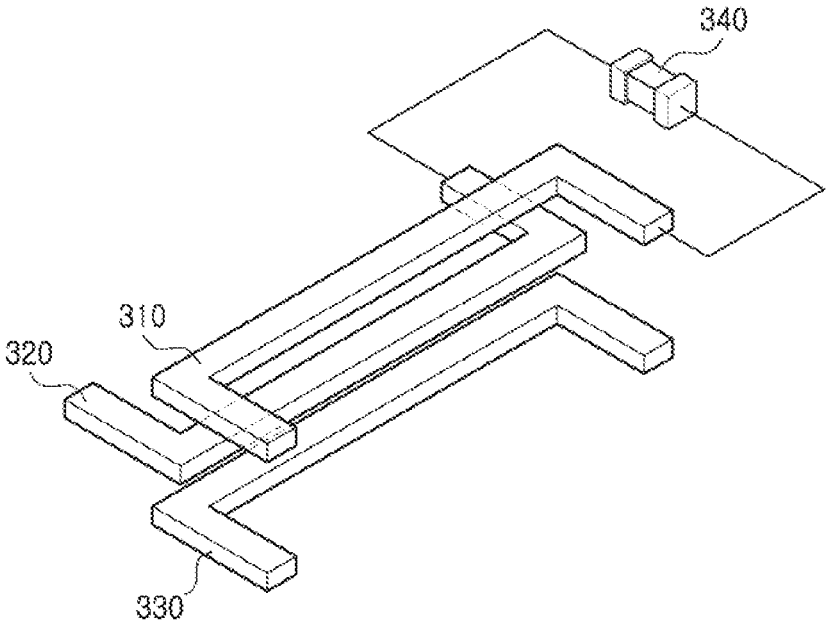
FIG. 8 is a perspective view schematically showing an example of a multilayer directional coupler.

FIG. 8 is a perspective view schematically illustrating an example of a multilayer directional coupler according to the present disclosure.

According to the example illustrated in FIG. 8, the multilayer directional coupler may further include a capacitor 340.

Referring to FIG. 8, the multilayer directional coupler may include the first conductive pattern 310, the second conductive pattern 320, the third conductive pattern 330, and the capacitor 340.

One end of the capacitor 340 may be connected to the first conductive pattern 310 and the other end thereof may be connected to the second conductive pattern 320. Alternatively, the capacitor 340 may have one end connected to the second conductive pattern 320 and the other end connected to the third conductive pattern 330.

In the example, the capacitor 340 may be formed on the uppermost layer substrate of the multilayer wireless communications device. That is, one end of the capacitor 340 may be connected to the first conductive pattern formed on the first substrate through the first via electrode, and the other end of the capacitor 340 may be connected to the second conductive pattern formed on the second substrate through the second via electrode.

It is to be noted that the capacitor may be used to adjust the setting of the multilayer directional coupler.

As set forth above, according to the examples in the present disclosure, the high mutual capacitance or the high coupling power may be provided by shortening the distance between the transmission lines.

In addition, according to the examples in the present disclosure, the capacitor may be connected between the conductive lines and the detailed setting of the multilayer directional coupler may be more smoothly performed by the capacitor.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A multilayer directional coupler disposed in a wireless communications device formed by stacking a plurality of substrates, the multilayer directional coupler comprising:

a first conductive pattern formed on a first substrate among the plurality of substrates;

a second conductive pattern formed on a second substrate stacked on a surface of the first substrate and configured to have one or more conductive lines overlapping the first conductive pattern when viewed in a plane direction;

an air-gap between the first substrate and the second substrate; and a capacitor connecting the first conductive pattern and the second conductive pattern.

2. The multilayer directional coupler of claim 1, wherein the first conductive pattern has a first end connected to an input port and a second end connected to a through port, and the second conductive pattern has a first end connected to an isolation port and a second end connected to a coupling port.

3. The multilayer directional coupler of claim 2, wherein a number of ports of the directional coupler is greater than four.

4. The multilayer directional coupler of claim 1, wherein the first conductive pattern comprises:

a first partial pattern extending in a first direction;

a first terminal pattern having a first end connected to a first via electrode; and a second terminal pattern having a first end connected to a second via electrode.

5. The multilayer directional coupler of claim 4, wherein a first end of the first partial pattern is connected to the second end of the first terminal pattern, and the second end of the first partial pattern is connected to the second end of the second terminal pattern.

6. The multilayer directional coupler of claim 4, wherein the first conductive pattern comprises:

a first connection pattern connected to a first end of the first partial pattern and the second end of the first terminal pattern; and a second connection pattern connected to the second end of the first partial pattern and the second end of the second terminal pattern.

7. The multilayer directional coupler of claim 4, wherein the second conductive pattern comprises:

a second partial pattern at least partially overlapping the first partial pattern when viewed in the plane direction.

8. The multilayer directional coupler of claim 1, wherein the capacitor comprises a first end connected to the first conductive pattern and a second end connected to the second conductive pattern.

9. The multilayer directional coupler of claim 8, wherein the capacitor is disposed on an uppermost layer among the plurality of substrates and has the first end connected to the first conductive pattern through a first via electrode and the second end connected to the second conductive pattern through a second via electrode.

10. The multilayer directional coupler of claim 1, further comprising a third conductive pattern disposed on a third substrate stacked on a surface of the second substrate and configured to have one or more conductive lines overlapping with at least one of the first conductive pattern and the second conductive pattern when viewed in the plane direction.

11. The multilayer directional coupler of claim 1, wherein capacitance between the first conductive pattern and the second conductive pattern is adjusted by controlling capacitance values of the capacitor.

12. A multilayer directional coupler disposed in a wireless communications device formed by stacking a plurality of substrates, the multilayer directional coupler comprising:

a first conductive pattern formed on a first substrate among the plurality of substrates;

a second conductive pattern formed on a second substrate stacked on a surface of the first substrate and configured to have one or more conductive lines overlapping the first conductive pattern when viewed in a plane direction;

a third conductive pattern formed on a third substrate stacked on a surface of the second substrate and configured to have one or more conductive lines overlapping with at least one of the first conductive pattern and the second conductive pattern when viewed in the plane direction;

a first capacitor connecting the first conductive pattern and the second conductive pattern; and a second capacitor connecting the second conductive pattern and the third conductive pattern.

13. The multilayer directional coupler of claim 12, wherein the first conductive pattern has a first end connected to a first input port and a second end connected to a first through port, the second conductive pattern has a first end connected to an isolation port and a second end connected to a coupling port, and the third conductive pattern has a first end connected to a second input port and a second end connected to a second through port.

14. The multilayer directional coupler of claim 12, wherein the first conductive pattern comprises:

a first partial pattern extending in a first direction;

a first terminal pattern having a first end connected to a first via electrode; and a second terminal pattern having a first end connected to a second via electrode.

15. The multilayer directional coupler of claim 14, wherein the second conductive pattern comprises:

a second partial pattern at least partially overlapping the first partial pattern when viewed in the plane direction.

16. The multilayer directional coupler of claim 15, wherein the third conductive pattern comprises:

a third partial pattern at least partially overlapping the first partial pattern and the second partial pattern when viewed in the plane direction.

17. The multilayer directional coupler of claim 12, wherein the first capacitor comprises a first end connected to the first conductive pattern and a second end connected to the second conductive pattern.

18. The multilayer directional coupler of claim 17, wherein the capacitor is disposed on an uppermost layer among the plurality of substrates and has the first end connected to the first conductive pattern through a first via electrode and the second end connected to the second conductive pattern through a second via electrode.

19. The multilayer directional coupler of claim 12, wherein the second capacitor comprises a first end connected to the third conductive pattern and a second end connected to the second conductive pattern.

20. The multilayer directional coupler of claim 12, further comprising at least one air-gap between the first substrate, the second substrate, and the third substrate.

* * * * *